US005299799A

United States Patent [19]

Filsinger et al.

[11] Patent Number: 5,299,799

[45] Date of Patent: Apr. 5, 1994

[54] FEED TABLE IN THE VICINITY OF A SIDE LAY

[75] Inventors: Karl-Heinz Filsinger, Wiesloch; Peter Thoma, Mannheim, both of Fed. Rep. of Germany

[73] Assignee: Heidelberger Druckmaschinen AG, Heidelberg, Fed. Rep. of Germany

[21] Appl. No.: 45,326

[22] Filed: Apr. 7, 1993

[30] Foreign Application Priority Data

Apr. 9, 1992 [DE] Fed. Rep. of Germany ..... 4211927

[51] Int. Cl.[5] ..... B65H 9/00

[52] U.S. Cl. ..... 271/250; 271/253

[58] Field of Search ..... 271/145, 248, 250, 251, 271/252, 253–255

[56] References Cited

U.S. PATENT DOCUMENTS 3,227,443 1/1966 Pasquinelli .
4,573,677 3/1986 Cuir ..... 271/253 X
4,844,441 7/1989 Motohashi ..... 271/253 X

FOREIGN PATENT DOCUMENTS 0268693 6/1988 European Pat. Off. .
4105966 5/1992 Fed. Rep. of Germany .
2253204 9/1992 United Kingdom .

*Primary Examiner*—Richard A. Schacher
*Attorney, Agent, or Firm*—Herbert L. Lerner; Laurence A. Greenberg

[57] ABSTRACT

Feed table in the vicinity of a side lay of a sheet-fed printing press includes a table cover having a continuous surface between a table surface covering a center of a feed table and a side lay, the table cover having the continuous surface being formed with regions having at least one characteristic of being compressible and expandable in a direction of lateral displacement of the side lay, support elements defining a uniform sheet guiding plane and being adjustable in position in the direction of lateral displacement of the side lay, and a device for adjusting the position of the support elements in accordance with an extent of compression and expansion, respectively, of the compressible and expandable regions.

14 Claims, 4 Drawing Sheets

FEED TABLE IN THE VICINITY OF A SIDE LAY

The invention relates to a feed table in the vicinity of a side lay of a sheet-fed printing press.

From U.S. Pat. No. 3,227,443, it has become known heretofore to construct a table cover in the vicinity of side lays for the purpose of effecting infinitely variable format adjustments. The table cover is formed of individual, mutually connected chain-shaped cover elements which are displaceable in guides extending parallel to the table surface, simultaneously with a lateral adjustment of the side lays in the direction of the width of the table. Close to the center of the table, the cover elements are guided under a table plate which covers the table center and are further guided parallel to and below the table plate towards the table center. With such a feed table, adjustments to larger formats require a rather long row of cover elements. When the row of cover elements is long, however, the possibility of adjusting to very small paper formats is prevented.

From European Patent 0 268 693, a sheet feeding surface has become known which is formed of joined U or V-shaped bent spring elements disposed in the plane of a feed table and situated between a table plate covering the table center and side lays. When the sheet format is reduced, the angular range or angle sector enclosed by the legs of each individual spring element is reduced. An elongation of the spring elements in the sheet conveying direction thus occurs. This so-called breathing or flexing of the spring elements in the sheet conveying direction requires that a gap extending transversely to the sheet conveying direction be provided in the sheet conveying plane, respectively in front of and behind the spring elements, as viewed in the sheet conveying direction. This gap represents a so-called "stumbling block" for the paper sheets to be conveyed. The danger thus resulting therefrom is especially great for very large sheet formats. With such a feed table, there is also the danger that unwanted particles may penetrate through the plane of the table. Thus, dirt, grease and abrasive particles from the region below the feed table, e.g., the drive region of the side lay, on the one hand, may penetrate to the sheet transport plane, and paper sheets may become smudged or damaged thereby, and also damage may be done to printing-unit parts, e.g., the rubber blanket and the printing plate, respectively, arranged behind the feed table, due to dirt particles being transported by the conveyed paper sheets. On the other hand, particles adhering to the paper sheet, such as paper dust, may get into the drive regions below the feed table, for example the drive region of the side lay. Therefore, reliable sheet guidance is not assured with such a feed table.

It is accordingly an object of the invention to provide a feed table which assures reliable sheet guidance and enables satisfactory format adjustment in the vicinity of a side lay of a sheet-fed printing press.

With the foregoing and other objects in view, there is provided, in accordance with the invention, a feed table in the vicinity of a side lay of a sheet-fed printing press, comprising a table cover having a continuous surface between a table surface covering a center of a feed table and a side lay, the table cover having the continuous surface being formed with regions having at least one characteristic of being compressible and expandable in a direction of lateral displacement of the side lay, support elements defining a uniform sheet guiding plane and being adjustable in position in the direction of lateral displacement of the side lay, and means for adjusting the position of the support elements in accordance with an extent of compression and expansion, respectively, of the compressible and expandable regions.

The fact that the table covering has a continuous surface, i.e., has a closed surface, prevents an unwanted exchange of interfering or disruptive particles between the region above the feed table and the region below the feed table. The construction of such a table cover having regions which are compressible and/or expandable in the direction of lateral displacement of the side lay enables format adjustment within a very wide format adjustment range, down to a very small minimal format. The support elements permit a smooth, virtually seamless transition in the guidance of the sheets from a sheet guide plate arranged in front of the support elements and past the support elements to a sheet guide plate arranged behind the support elements. The danger of any large unwanted "stumbling blocks" is thus eliminated.

In accordance with another feature of the invention, the table cover having the continuous surface is formed with foldable regions extending in the direction of lateral displacement of the side lay. With this feature, an especially simple construction is afforded.

In accordance with a further feature of the invention, the table cover having the continuous surface is formed of mutually adjacent plates articulatingly connected to one another in the direction of lateral displacement of the side lay.

In accordance with an added feature of the invention, the plates articulatingly connected to one another are provided with a common tension-proof, flexible foil.

The foregoing last two features provide advantageous constructions, in that covering the plates with a flexible foil offers an especially simple manner of articulatingly connecting the individual plates to one another, which gives excellent protection against any transmission of unwanted particles. The rigidity of the plates permits uniform folding-together and unfolding, respectively, of the table cover.

In accordance with an additional feature of the invention, the table cover having the continuous surface is formed of inherently stable, flexible foil material, the foil material having upwardly bendable, flexible permanent creases extending perpendicularly to the direction of lateral displacement of the side lay. This provides an especially simple, lowcost construction of the table cover having the continuous surface which offers excellent sealing action. Due to the thinness of such a foil, this construction permits adjustment to a very small sheet format.

In accordance with yet another feature of the invention, the foil material is formed of polyester fabric having creases permanently pressed therein.

In accordance with an alternate feature of the invention, the foil material is formed of cotton fabric having permanently pressed-in creases.

The last two constructions represent advantageous forms of the foil material structure.

In accordance with yet a further feature of the invention, a plurality of mutually parallel equidistant holding plates extend in the direction of the lateral displacement of the side lay, below the sheet guiding plane and perpendicularly to the table surface, and in a sequence wherein a first one of the holding plates is fastened to the table surface covering the table center, and a last one of the holding plates is fastened to the side lay, and respective plates of mutually like size articulatingly fastened to each of the holding plates, the foil material being articulatingly mounted on the equidistantly arranged holding plates and having the pressed-in creases, respectively, located intermediate respective pairs of the holding plates.

In accordance with yet an added feature of the invention, the feed table includes a plurality of mutually parallel equidistant holding plates extending in the direction of the lateral displacement of the side lay, below the sheet guiding plane and perpendicularly to the table surface, and in a sequence wherein a first one of the holding plates is fastened to the table surface covering the table center, and a last one of the holding plates is fastened to the side lay, and including respective plates of mutually like size articulatingly fastened to each of the holding plates, except the first and last ones of the holding plates, on both sides thereof, one of the plates, respectively, being articulatingly fastened to the first and the last ones of the holding plates at a respective side thereof facing towards the respective holding plate located adjacent thereto, the adjacent plates, respectively, mutually facing one another having free ends by which they are articulatingly connected to one another.

An advantageous arrangement of the foil material is afforded by the foregoing last two constructional features.

In accordance with yet an additional feature of the invention, the support elements are fastened to the holding plates, and means are provided for guiding the support elements in the direction of lateral displacement of the side lay.

In accordance with another feature of the invention, the support elements defining the uniform sheet guiding plane are connected with the table cover for entrainment thereby, the support elements defining the uniform sheet guiding plane being arranged so as to be equidistant from one another, and means are included for guiding the support elements in the direction of lateral displacement of the side lay.

In accordance with a further feature of the invention, the support elements are support brackets, and guide rods are fastened in machine side walls and extend in the direction of lateral displacement of the side lay for guiding the support brackets.

The aforementioned last three features permit an advantageous construction of the means for adjusting the position of the support elements for assuring a reliable sheet guidance.

In accordance with a concomitant feature of another embodiment of the invention, the table cover having the continuous surface is formed with chambers for air intake or air discharge, the chambers extending perpendicularly to the direction of lateral displacement of the side lays, and being defined by elastically deformable upper and lower covering surfaces of the chambers being.

Other features which are considered as characteristic for the invention are set forth in the appended claims.

Although the invention is illustrated and described herein as embodied in a feed table in the vicinity of a side lay, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
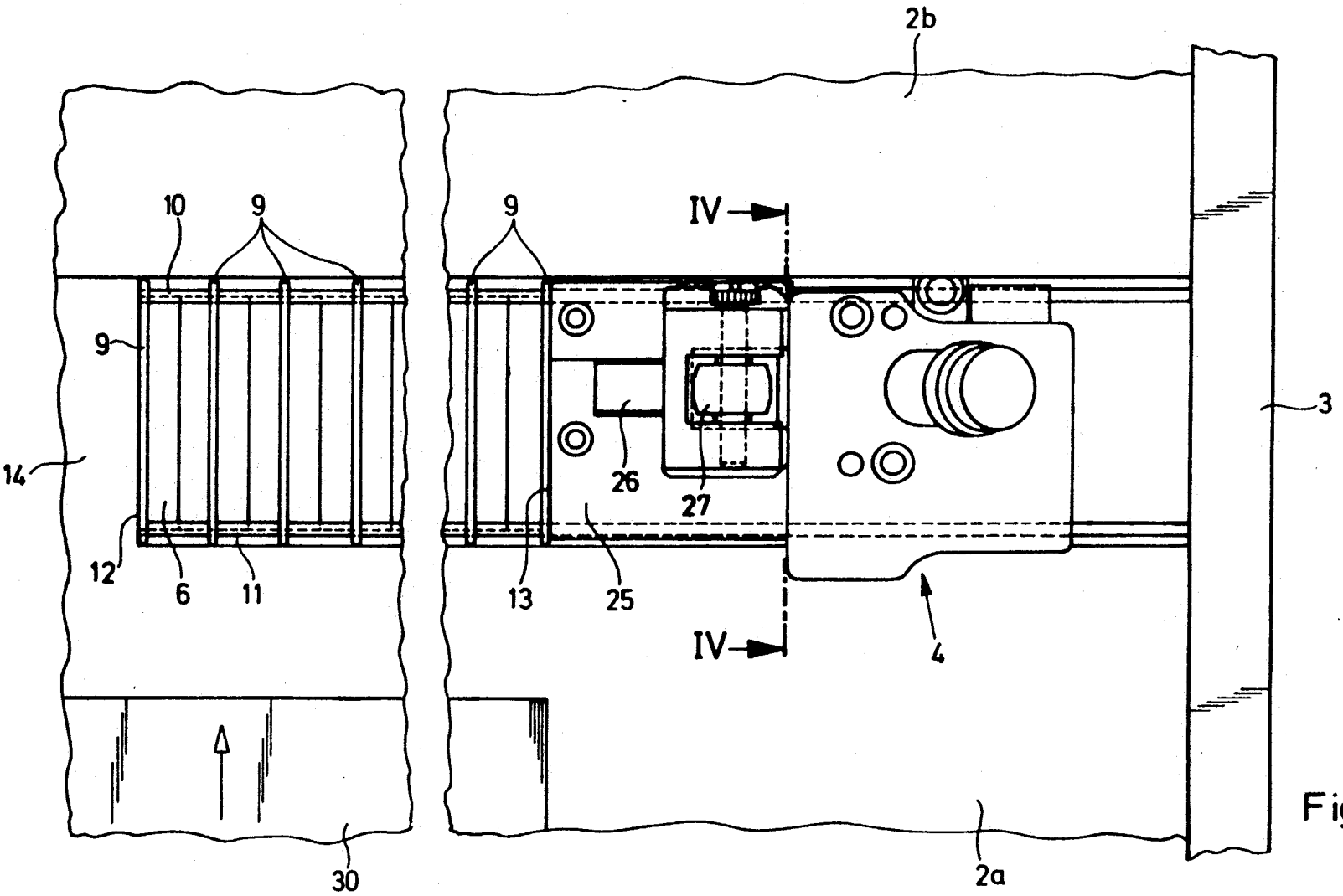
FIG. 1 is a fragmentary plan view, partly broken away, of the feed table, according to the invention, in the vicinity of a laterally adjustable side lay.
Figure 2:
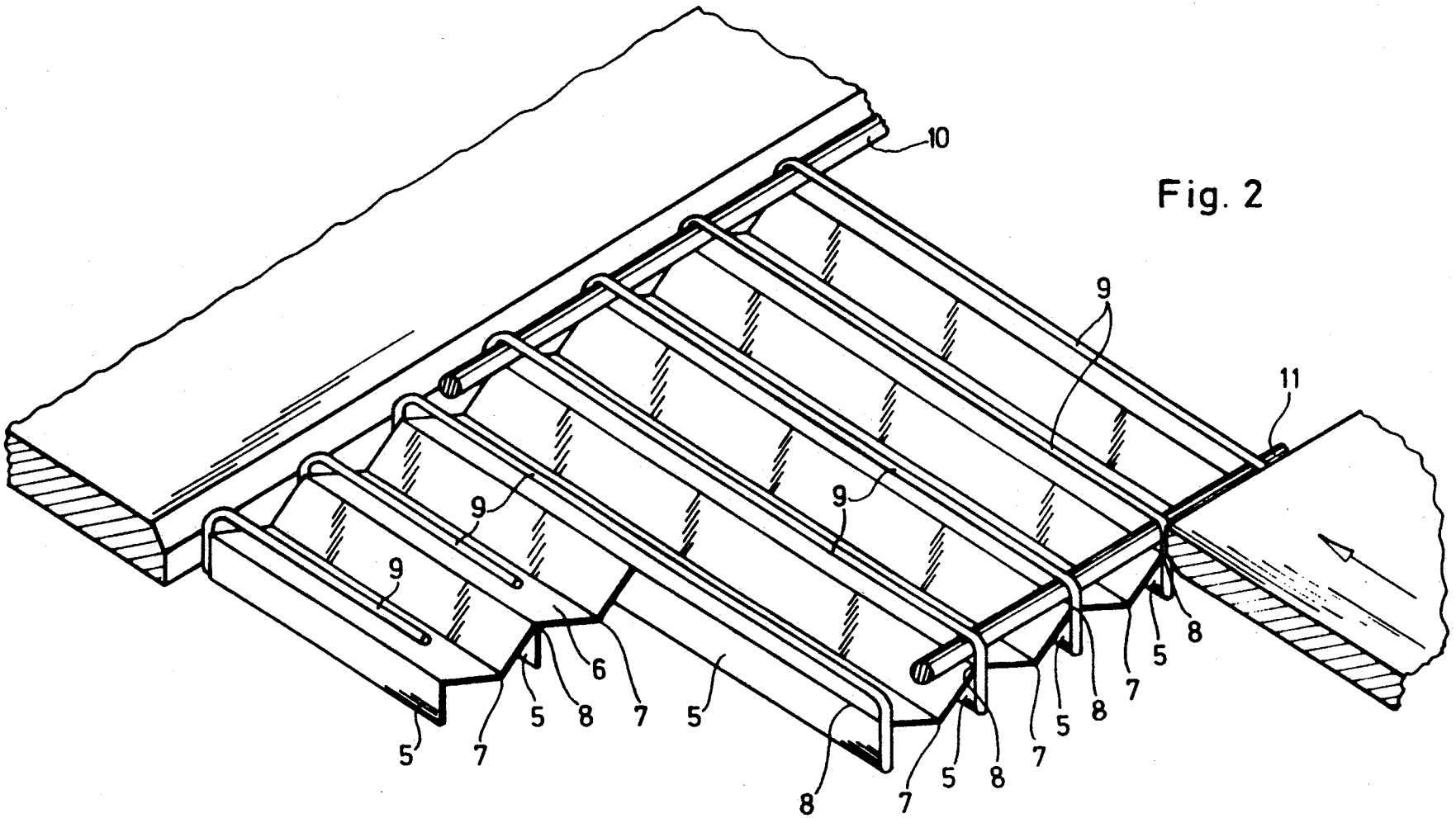
FIG. 2 is an enlarged fragmentary perspective view, partly in section and partly broken away, of FIG. 1, showing a table cover forming part of the invention.
Figure 3A:
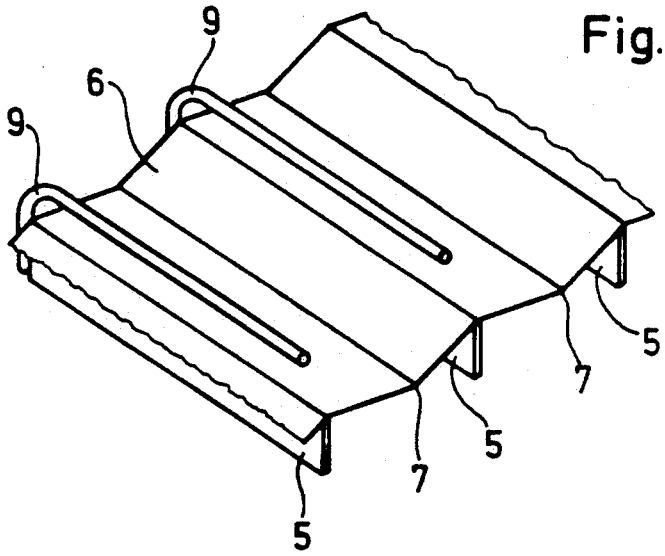
Figure 3B:
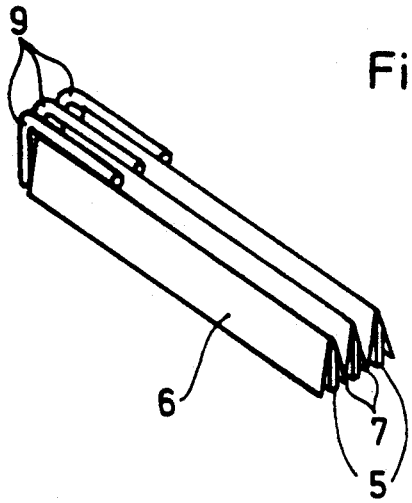
Figure 4:
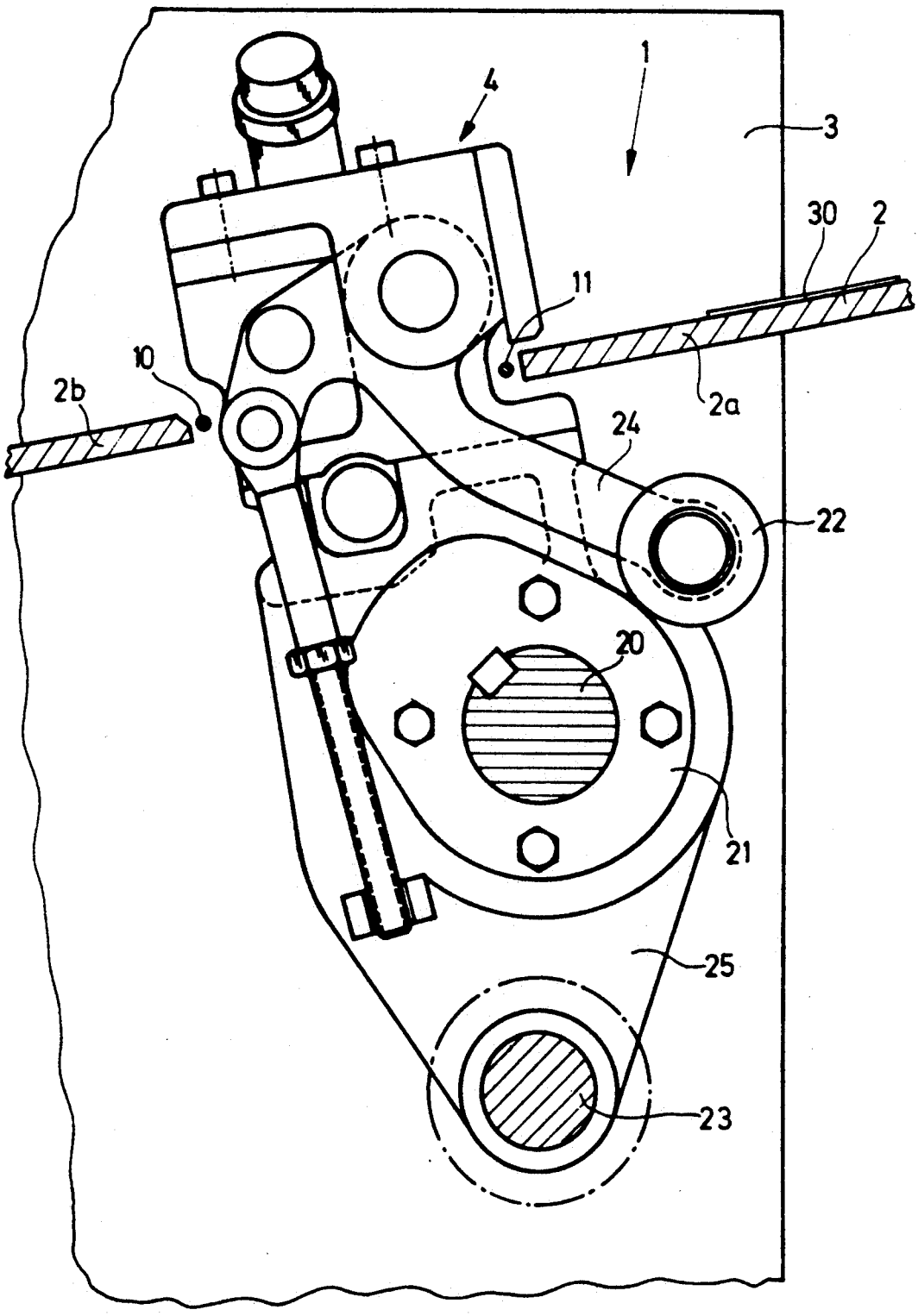

FIG. 3*a* is a fragmentary view of FIG. 1 showing part of the table cover in an operating phase thereof wherein it is set for very large paper-sheet formats;

FIG. 3*b* is a view like that of FIG. 3*a* showing the part of the table cover in another operating phase thereof wherein it is set for very small paper-sheet formats; and FIG. 4 is a cross-sectional view of FIG. 1 taken along the line IV—IV in the direction of the arrows.

Referring now to the drawings and, first, particularly to FIGS. 1 and 4 thereof, there is shown therein part of a feed table 1 of a sheet-fed rotary offset printing press. Between side walls, of which only a right-hand side wall 3, as viewed in sheet-conveying direction represented by the arrow at the lower right-hand side of FIG. 1, is illustrated, a table top or plate 2 (FIG. 4) of a feed table is mounted. Paper sheets 30 from a feed pile are conveyed by conveyor means over a side 2*a* of the feed table plate 2 into the range of action of a conventional side lay 4. After the paper sheets have been aligned by the side lay 4, they are conveyed further over a side 2*b* of the feed table plate 2 to a first printing unit. Feed pile, conveyor means and printing unit are not illustrated in the drawings, in the interest of clarity.

In the vicinity of the side lay 4, between the table plates 2*a* and 2*b*, as viewed in the sheet conveying direction represented by the vertical arrow at the lower left-hand side of FIG. 1, for example, and between a table-center covering surface 14 of the table plate 2*a* and the side lay 4, a foil 6 is arranged which covers the gaps formed thereat. The foil 6 is fastened,, for example, by the application of adhesive, to fastening locations or points 8 of holding plates 5 arranged equidistantly spaced from one another in the sheet conveying direction. At half the distance between two adjacent holding plates 5, respectively, the foil 6, which is formed of polyester fabric is provided with a permanent, downwardly creased, so-called steamed-in fold 7. A bracket 9 extending above the foil 6 is fastened to front and rear ends of each holding plate 5, as viewed in sheet conveying direction. The brackets 9 are disposed on two guide rods 10 and 11 so as to be laterally displaceable, the guide rods 10 and 11 extending transversely to the sheet conveying direction and being arranged, respectively, in front and in the rear of the side lay 4 and fastened in the side walls or frames 3. The holding plate 5 adjacent to the region 14 of the plate 2*a* covering the table center is fastened to the plate 2*a* at a fastening location 12. One of the holding plates 5 adjacent to the side lay 4 is fastened to a body part 25 of the side lay at a fastening location 13.

As shown in FIGS. 1 and 4, a conventional side lay 4 having a pull-type rail 26 entraining the paper sheet 30 from below, and having a contact roller 27 acting cyclically on the sheet 30 from above, in order to establish friction contact for the sheet entrainment, is fastened so as to be laterally displaceable. The side lay 4 is displaceably supported by the body part 25 thereof on a drive shaft 20 which is mounted in the side walls 3 below the feed table plate 2. Furthermore, the body part 25 below the feed table plate 2 is formed with a threaded bore for threadedly receiving therein a spindle 23, which is also mounted in the side walls 3.

The pull-type rail 26 is mounted in the body part 25 of the side lay 4 so as to be laterally displaceable, transversely to the paper sheet conveying direction. The pull-type rail 26 is operatively connected with a non-illustrated axial control cam which is mounted on the drive shaft 20 so as to be fixed against rotation relative thereto, and is displaceable together with the body part 25. The contact roller 27 has a non-illustrated driving connection with a lever 24. A cam-sensing roller or cam follower 22, which is in operative engagement with a radial cam 21, is journalled in the lever 24. The radial cam 21 is mounted on the drive shaft 20 so as to be fixed against rotation relative thereto and is axially displaceable together with the body part 25. Thus, by means of the non-illustrated axial control cam, the pull-type rail 26 is cyclically displaced by the driven drive shaft 20 for moving the paper sheet 30 against a non-illustrated lateral stop in the side lay 4, the contact roller 27 being raised and lowered cyclically by means of the radial cam 21.

With the lateral displacement of the side lay 4 by means of the spindle 23, the holding plate 5 fastened to the fastening location 13 is also laterally displaced. When adjustment is made to a smaller paper sheet format, e.g. by displacing the side lay in a direction towards the center of the table, the inherently stable, flexible foil 6 is folded together due to the movement of the holding plate 5 fastened to the fastening location 13 (note FIGS. 1 and 3*b*). The support brackets 9 are thus moved equidistantly closer together due to the movement of the holding plates 5. When increasing or enlarging paper sheet format according to FIG. 3*a*, the foil 6 is unfolded due to the movement of the fastening location 13. Thus, the support brackets 9 are moved equidistantly farther apart due to the movement of the holding plates 5.

The brackets 9 are arranged so that a side thereof facing away from the foil 6 lies substantially in the sheet conveying plane. The side of the brackets 9 facing away from the respective holding plate 5 assigned thereto, is brought into sliding-friction contact with the table plates 2*a* and 2*b*.

To increase the sealing effect, the foil 6 can be given such large dimensions that it comes into sliding contact with the side plates 2*a* and 2*b*. The foil 6 must then be provided with recesses in the region of the brackets 9, in order for the brackets 9 to penetrate the foil.

It is feasible, as well, to use very soft, flexible foil on which, for the purpose of increasing the inherent stability, thin, stable plates are fastened in the non-folded region thereof.

We claim:

1. Feed table in the vicinity of a side lay of a sheet-fed printing press, comprising a table cover having a continuous surface between a table surf ace covering a center of a feed table and a side lay, said table cover having said continuous surface being formed with regions having at least one characteristic of being compressible and expandable in a direction of lateral displacement of said side lay, support elements defining a uniform sheet guiding plane and being adjustable in position in said direction of lateral displacement of said side lay, and means for adjusting the position of said support elements in accordance with an extent of compression and expansion, respectively, of said compressible and expandable regions.

2. Feed table according claim 1, wherein said table cover having said continuous surface is formed with foldable regions extending in said direction of lateral displacement of said side lay.

3. Feed table according to claim 2, wherein said table cover having said continuous surface is formed of mutually adjacent plates articulatingly connected to one another in said direction of lateral displacement of said side lay.

4. Feed table according to claim 3, wherein said plates articulatingly connected to one another are provided with a common tension-proof, flexible foil.

5. Feed table according to claim 2, wherein said table cover having said continuous surface is formed of inherently stable, flexible foil material, said foil material having upwardly bendable, flexible permanent creases extending perpendicularly to said direction of lateral displacement of said side lay.

6. Feed table according to claim 5, wherein said foil material is formed of polyester fabric having creases permanently pressed therein.

7. Feed table according to claim 5, wherein said foil material is formed of cotton fabric having permanently pressed-in creases.

8. Feed table according to claim 5, including a plurality of mutually parallel equidistant holding plates extending in said direction of said lateral displacement of the side lay, below said sheet guiding plane and perpendicularly to said table surface, and in a sequence wherein a first one of said holding plates is fastened to said table surface covering said table center, and a last one of said holding plates is fastened to the side lay, and including respective plates of mutually like size articulatingly fastened to each of said holding plates, said foil material being articulatingly mounted on said equidistantly arranged holding plates and having said pressed-in creases, respectively, located intermediate respective pairs of said holding plates.

9. Feed table according to claim 8, wherein said support elements are fastened to said holding plates, and means for guiding said support elements in said direction of lateral displacement of said side lay.

10. Feed table according to claim 3, including a plurality of mutually parallel equidistant holding plates extending in said direction of said lateral displacement of the side lay, below said sheet guiding plane and perpendicularly to said table surface, and in a sequence wherein a first one of said holding plates is fastened to said table surface covering said table center,, and a last one of said holding plates is fastened to the side lay, and including respective plates of mutually like size articulatingly fastened to each of said holding plates, except said first and last ones of said holding plates, on both sides thereof, one of said plates, respectively, being articulatingly fastened to said first and said last ones of said holding plates at a respective side thereof facing towards the respective holding plate located adjacent thereto, the adjacent plates, respectively, mutually facing one another having free ends by which they are articulatingly connected to one another.

11. Feed table according to claim 10, wherein said support elements are fastened to said holding plates, and means for guiding said support elements in said direction of lateral displacement of said side lay.

12. Feed table according to claim 1, wherein said support elements defining said uniform sheet guiding plane are connected with the table cover for entrainment thereby, said support elements defining said uniform sheet guiding plane are arranged so as to be equidistant from one another, and including means for guiding said support elements in said direction of lateral displacement of said side lay.

13. Feed table according to claim 11, wherein said support elements are support brackets, and including guide rods fastened in machine side walls and extending in said direction of lateral displacement of said side lay for guiding said support brackets.

14. Feed table according to claim 1, wherein said table cover having said continuous surface is formed with chambers for air intake or air discharge, said chambers extending perpendicularly to said direction of lateral displacement of said side lays, and being defined by elastically deformable upper and lower covering surfaces of said table cover.

* * * * *